US005464948A

United States Patent [19]

Lace

[11] Patent Number: 5,464,948

[45] Date of Patent: Nov. 7, 1995

[54] SENSOR ASSEMBLY FOR A STRINGED MUSICAL INSTRUMENT

[75] Inventor: Jeffrey J. Lace, Huntington Beach, Calif.

[73] Assignee: Actodyne General, Inc., Huntington Beach, Calif.

[21] Appl. No.: 231,115

[22] Filed: Apr. 22, 1994

[51] Int. Cl.[6] ..... G10H 3/18

[52] U.S. Cl. ..... 84/726

[58] Field of Search ..... 84/723, 725, 726

[56] References Cited

U.S. PATENT DOCUMENTS

| | | |
|---|---|---|
| Re. 32,520 | 10/1987 | Lace . |
| 2,089,171 | 8/1937 | Beauchamp . |
| 2,119,584 | 6/1938 | Knoblaugh . |
| 2,175,325 | 10/1939 | Sunshine . |
| 2,209,016 | 7/1940 | Dickerson . |
| 2,294,861 | 9/1942 | Fuller . |
| 2,445,046 | 7/1948 | Tinkham . |
| 2,557,754 | 6/1951 | Morrison . |
| 2,567,570 | 9/1951 | McCarty . |
| 2,573,254 | 10/1951 | Fender . |
| 2,612,541 | 9/1952 | De Armond . |
| 2,683,388 | 7/1954 | Keller . |
| 2,725,778 | 12/1955 | Cronwell . |
| 2,764,052 | 9/1956 | McBride . |
| 2,817,261 | 12/1957 | Fender . |
| 2,892,371 | 6/1959 | Butts . |
| 2,896,491 | 7/1959 | Lover . |
| 2,909,092 | 10/1959 | De Armond et al. . |
| 2,911,871 | 11/1959 | Schultz . |
| 2,968,204 | 1/1961 | Fender . |
| 2,976,755 | 3/1961 | Fender . |
| 3,066,567 | 12/1962 | Kelley, Jr. . |
| 3,183,296 | 5/1965 | Miessner . |
| 3,236,930 | 2/1966 | Fender . |
| 3,249,677 | 5/1966 | Burns et al. . |
| 3,290,424 | 12/1966 | Fender . |
| 3,417,268 | 12/1968 | Lace . |
| 3,483,303 | 12/1969 | Warner . |
| 3,530,228 | 9/1970 | Scherer . |
| 3,535,968 | 10/1970 | Rickard . |
| 3,541,219 | 11/1970 | Abair . |
| 3,571,483 | 3/1971 | Davidson . |
| 3,588,311 | 6/1971 | Zoller . |
| 3,602,627 | 8/1971 | McCammon . |
| 3,657,461 | 4/1972 | Freeman . |
| 3,668,295 | 6/1972 | Broussard . |
| 3,711,619 | 1/1973 | Jones et al. . |
| 3,715,446 | 2/1973 | Kosinski . |
| 3,725,561 | 4/1973 | Paul . |
| 3,902,394 | 9/1975 | Stich . |
| 3,911,777 | 10/1975 | Rendell . |
| 3,916,751 | 11/1975 | Stich . |
| 3,962,946 | 6/1976 | Rickard . |
| 3,983,777 | 10/1976 | Bartolini . |
| 3,983,778 | 10/1976 | Bartolini . |
| 4,026,178 | 5/1977 | Fuller . |
| 4,056,255 | 11/1977 | Lace . |
| 4,133,243 | 1/1979 | DiMarzio . |
| 4,138,178 | 2/1979 | Miller et al. . |
| 4,184,399 | 1/1980 | Zuniga . |
| 4,220,069 | 9/1980 | Fender . |
| 4,222,301 | 9/1980 | Valdez . |
| 4,268,771 | 5/1981 | Lace . |
| 4,269,103 | 5/1981 | Underwood . |
| 4,283,982 | 8/1981 | Armstrong . |
| 4,320,681 | 3/1982 | Altilio . |
| 4,364,295 | 12/1982 | Stich . |
| 4,372,186 | 2/1983 | Aaroe . |
| 4,379,421 | 4/1983 | Nunan . |
| 4,394,830 | 7/1983 | Damiano . |
| 4,433,603 | 2/1984 | Siminoff . |
| 4,442,749 | 4/1984 | DiMarzio et al. . |

(List continued on next page.)

*Primary Examiner*—William M. Shoop, Jr.
*Assistant Examiner*—Jeffrey W. Donels
*Attorney, Agent, or Firm*—Bliss McGlynn

[57] ABSTRACT

A sensor assembly for a stringed musical instrument having a plurality of moveable strings includes a case having a longitudinal channel, at least one magnet disposed in the channel along an interior surface of the case, at least one coil disposed in the longitudinal channel, and a structure for locking the coil within the longitudinal channel.

20 Claims, 4 Drawing Sheets

U.S. PATENT DOCUMENTS 4,463,648 8/1984 Fender .
4,472,994 9/1984 Armstrong .
4,501,186 2/1985 Ikuma .
4,524,667 6/1985 Duncan .
4,535,668 8/1985 Schaller .
4,580,481 4/1986 Schaller et al. .
4,624,172 11/1986 McDougall .
4,632,003 12/1986 Kopp .
4,738,178 4/1988 Deering .
4,809,578 3/1989 Lace, Jr. .
4,854,210 8/1989 Palazzolo .
4,878,412 11/1989 Resnick .
4,941,389 7/1990 Wendler .
4,949,619 8/1990 von Matlzan .
5,012,716 5/1991 Pagelli .
5,041,784 8/1991 Griebeler .
5,148,733 9/1992 Beller .
5,221,805 6/1993 Lace .
5,336,845 8/1994 Lace, Sr. ..... 84/726

FIG 1
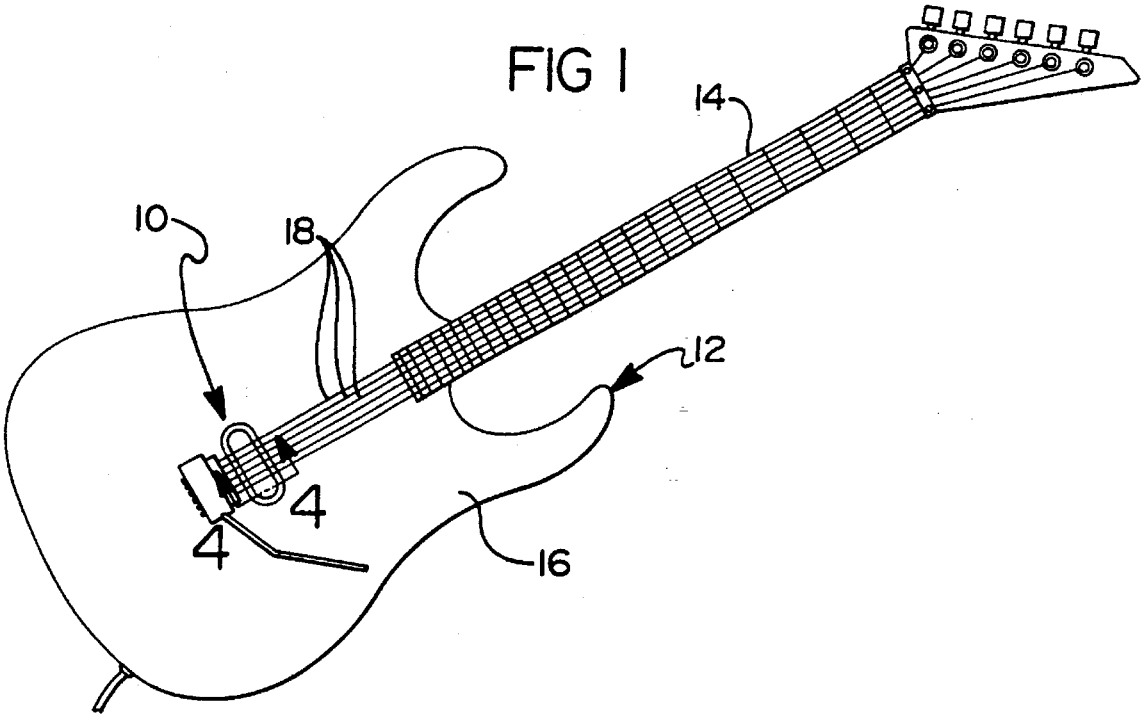
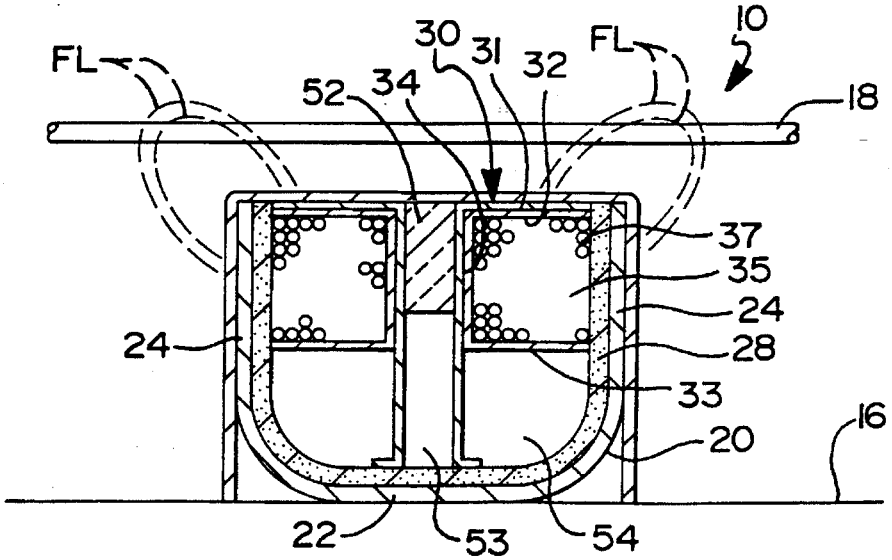
FIG 4

SENSOR ASSEMBLY FOR A STRINGED MUSICAL INSTRUMENT

BACKGROUND OF THE INVENTION

1. Field of the Invention

The present invention relates generally to musical instruments and, more particularly, to a sensor assembly for use with stringed musical instruments.

2. Description of the Related Art

Generally, stringed musical instruments such as electric guitars have electromagnetic sensors or pick-ups for sensing mechanical vibrations of the strings and converting such into electrical signals. The electrical signals from the electromagnetic sensors are amplified and modified and, ultimately, reconverted into acoustical energy to produce music and the like.

An example of such an electromagnetic sensor is disclosed in U.S. Pat. No. 4,809,578, issued Mar. 7, 1989, entitled "Magnetic Field Shaping In An Acoustic Pick-up Assembly", the disclosure of which is hereby incorporated by reference. This patented sensor assembly includes an elongated ferromagnetic case lined on the interior thereof with planar permanent magnet pieces to present the same magnetic polarity into the interior thereof. The patented sensor assembly also includes cores disposed in the interior of the case and having a plurality of coplanar, spaced, finger-like projections directed at the walls of the case. The walls and projections are permanently magnetized to a common magnetic polarity which will concentrate by magnetic repulsion flux into gaps between the projections. The patented sensor assembly further includes a coil wound around the cores and the flux changes of these concentrated flux fields due to string motion induce a voltage in the coil. The coil has terminals connected to a socket in the stringed musical instrument for connection to an amplifier and speaker system.

Although the above patented sensor assembly has worked well, it is typically more expensive to manufacture and assemble than conventional pick-ups. Moreover, musicians which play stringed musical instruments are desirous of having sensors which incorporate greater sensitivity to the full range of acoustic energy generated by the movement of such strings than conventional pick-ups. However, such greater sensitivity often requires a sensor which is more expensive to manufacture and assemble than conventional pick-ups. Thus, there is a need in the art to provide a sensor assembly which has greater sensitivity than conventional pick-ups and is less expensive to manufacture and assemble than current sensor assemblies.

SUMMARY OF THE INVENTION

It is, therefore, one object of the present invention to provide a sensor assembly for a stringed musical instrument.

It is another object of the present invention to provide a sensor assembly which has a greater sensitivity than conventional pick-ups.

It is a further object of the present invention to provide a sensor assembly which is less expense to manufacture and assemble than current sensor assemblies.

To achieve the foregoing objects, the present invention is a sensor assembly for a stringed musical instrument having a plurality of moveable strings. The sensor assembly includes a case having means for forming a longitudinal channel. The sensor assembly also includes at least one magnet disposed in the longitudinal channel for producing a magnetic polarity. The sensor assembly further includes a coil disposed in the longitudinal channel and means for locking the coil within the longitudinal channel.

One advantage of the present invention is that a sensor assembly is provided for a stringed musical instrument. Another advantage off the present invention is that the sensor assembly provides greater sensitivity than conventional pick-ups. A further advantage of the present invention is that the sensor assembly is less expensive to manufacture and assemble than current sensor assemblies.

Other objects, features and advantages of the present invention will be readily appreciated as the same becomes better understood after reading the subsequent description taken in conjunction with the accompanying drawings.

BRIEF DESCRIPTION OF THE DRAWINGS

FIG. 1 is perspective view of a sensor assembly, according to the present invention, illustrated in operational relationship to a stringed musical instrument.

FIG. 4 is a sectional view taken along line of FIG. 1.

DESCRIPTION OF THE PREFERRED EMBODIMENT(S)

Figure 2:
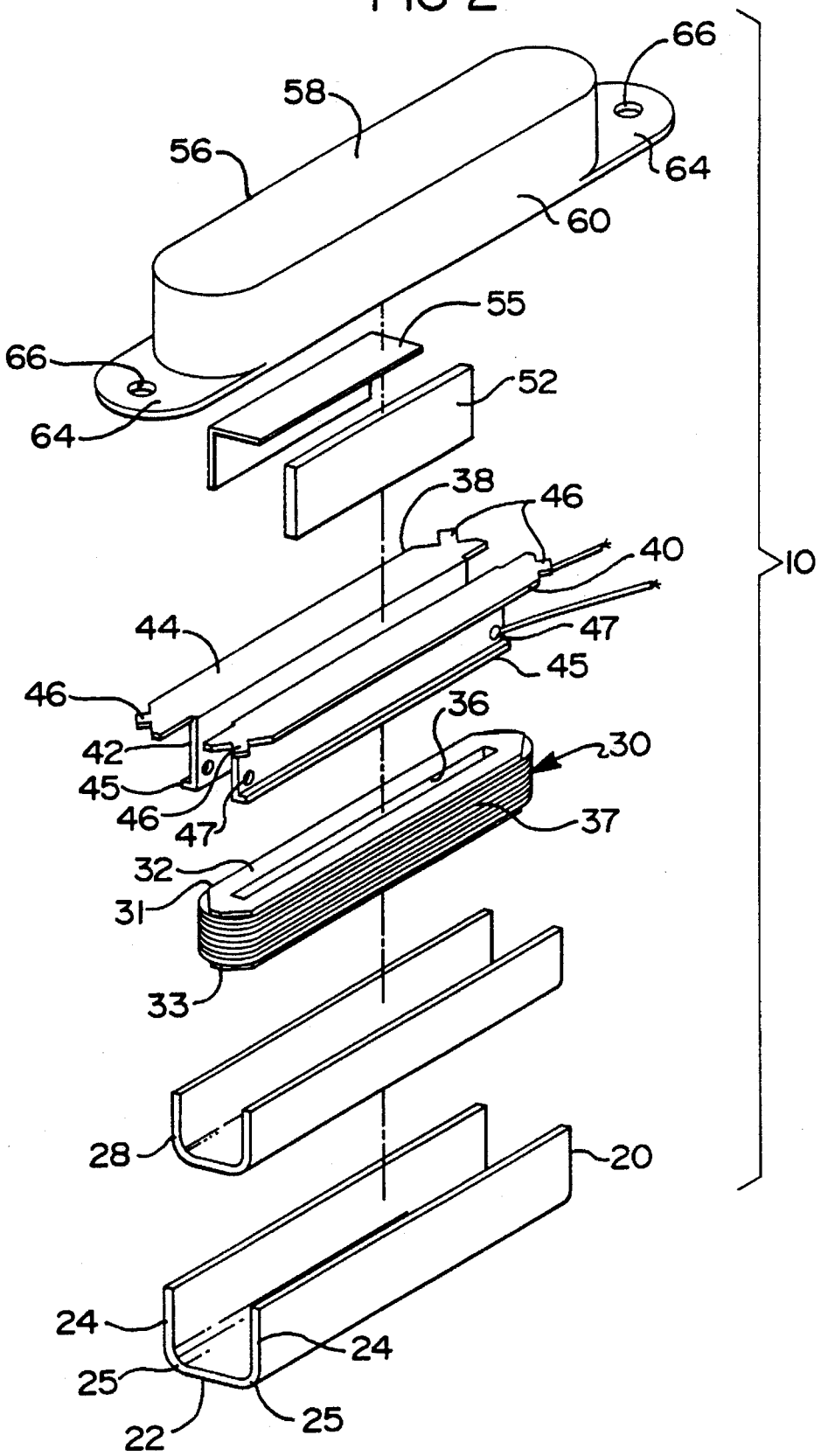
FIG. 2 is an exploded perspective view of the sensor assembly of FIG. 1.

Referring to the drawings and in particular to FIG. 1, a sensor assembly 10, according to the present invention, is illustrated in operational relationship with a stringed musical instrument such as a guitar, generally indicated at 12. The guitar 12 is of the electric type and has a neck portion 14, a body portion 16, and a plurality of strings 18 extending along the neck and body portions 14 and 16. The sensor assembly 10 is disposed beneath the strings 18 and mounted to the body portion 16 in a manner to be described.

Figure 3:
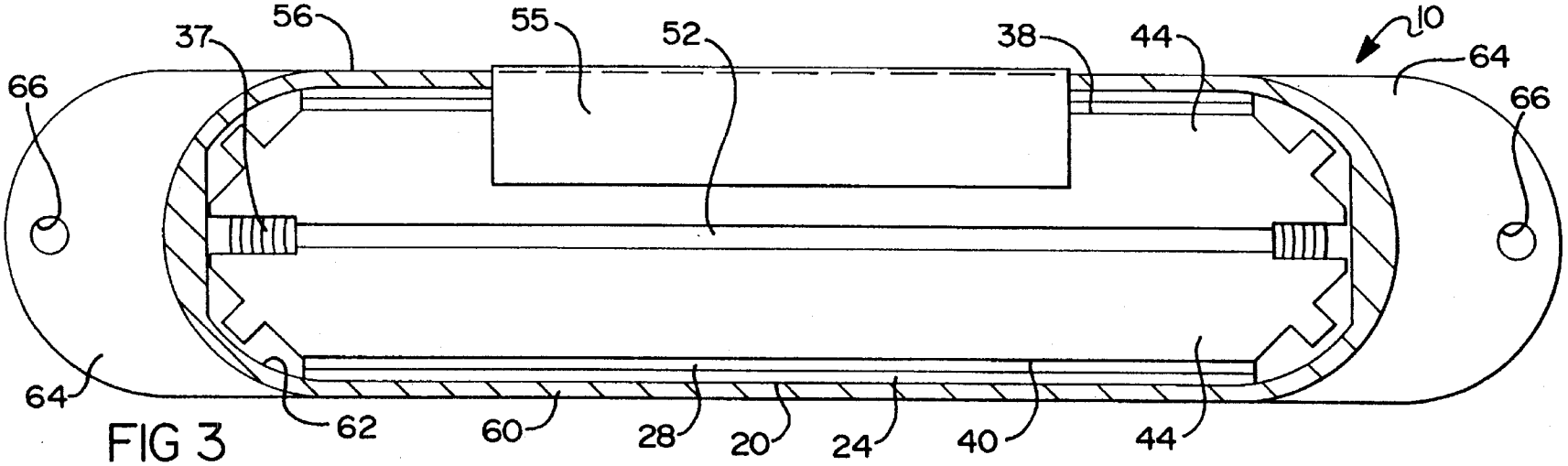
FIG. 3 is a fragmentary plan view of the sensor assembly of FIG. 1.

Referring to FIGS. 2 and 3, the sensor assembly 10 includes a case 20 extending longitudinally and having a general "U" shape cross-section. The case 20 has a generally planar base wall 22 and a pair of generally planar side walls 24 substantially parallel to each other and connected by generally arcuate shaped corner walls 25 to the base wall 22 to form a longitudinal channel 26. Preferably, the channel 26 has a lateral width greater than a height thereof. The case 20 is made as one-piece from a ferromagnetic material such as an iron based steel.

The sensor assembly 10 also includes at least one, preferably a single, permanent magnet strip 28 disposed in the channel 26 and mounted to interior surfaces of the side corner and base walls 24, 25 and 22, respectively, of the case 20 by suitable means such as an adhesive bonding agent. The permanent magnet strip 28 is made of a flexible permanent magnet material such as PLASTIFORM® which is commercially available from the 3M Company of St. Paul, Minn. The permanent magnet strip 28 extends longitudinally and is generally rectangular in shape. The permanent magnet strip 28 is flexed into a general U-shape and disposed in the channel 26. The permanent magnet strip 28 has a height near a height of the side walls 24.

When the permanent magnet strip 28 is disposed adjacent the case 20, the permanent magnet strip 28 presents a common magnetic polarity facing the interior of the channel 26. The permanent magnet strip 28 presents its north (N) magnetic polarity facing toward the interior of the channel 26 and its south (S) magnetic polarity impressed on the case 20. It should be appreciated that the permanent magnet strip 28 can be arranged to present an opposite polarity.

The sensor assembly 10 further includes at least one coil assembly, generally indicated at 30, disposed in the channel 26 adjacent the permanent magnet strip 28. The coil assembly 30 includes a bobbin 31 extending longitudinally and having a generally rectangular shape. The bobbin 31 is made of a plastic material such as nylon. The bobbin 31 has a generally planar top wall 32 and bottom wall 33 spaced vertically and generally parallel to each other. The corners of the top and bottom walls 32 and 33 may be chamfered. The bobbin 31 also has interior walls 34 generally perpendicular to the top and bottom walls 32 and 33 to form a recess 35 having a general "C" shape. The interior walls 34 are spaced laterally to form a generally rectangular space 36 extending through the top and bottom walls 32 and 33. The coil assembly 30 further includes a conductive wire such as copper wrapped or wound around the bobbin 31 and partially disposed is the recess 35 to form a coil 37. It should be appreciated that the coil assembly 30 may extend longitudinally beyond the ends of the case 20.

The sensor assembly 10 also includes a pair of comb pieces 38 and 40 having a general inverted "L" shape. The comb pieces 38 and 40 are made of a ferromagnetic material such as an iron based steel. The comb pieces 38 and 40 have a leg portion 42, an arm portion 44 extending generally perpendicular from an upper end of the leg portion 42 and a foot portion 45 extending generally perpendicular from a lower end of the leg portion 42. The leg portion 42 has a height greater than a lateral width of the arm portion 44. The arm portion 44 has a lateral width greater than a lateral width of the foot portion 45. The arm portion 44 also has a longitudinal length greater than a longitudinal length of the leg portion 42. The corners of the arm portions 44 are chamfered and may have a winding tab 46 extending outwardly from the chamfer. Each leg portion 42 has an aperture 47 near each end for connection to a lead 48. The leads 48 are connected to a socket (not shown) on the guitar 12 for connection to an amplifier and speaker system (not shown).

The comb pieces 38 and 40 are spaced laterally and orientated in a back to back relationship. The leg portions 42 are disposed in the space 36 of the coil assembly 30 such that the foot portions 45 extend beyond the coil 37 and abut the permanent magnet strip 28. The arm portions 44 are disposed over the coil 37 and adjacent the top wall 32 of the bobbin 31. It should be appreciated that the foot portions 45 increase the flux field for the sensor assembly 10.

The sensor assembly 10 further includes at least one insulating spacer 52 disposed in a space 53 between the comb pieces 38 and 40 such that the comb pieces 38 and 40 do not directly contact each other. The spacer 52 is generally rectangular in shape and made of a non-magnetic, non-conductive insulating material. The spacer 52 is of a sufficient width to press the combpieces 38 and 40 against the coil assembly 30 which is, in turn, pressed against the permanent magnet strip 28 and case 20 to lock the comb pieces 38 and 40 and coil assembly 30 into place within the channel 26 and from a space 54 between the bottom wall 33 of the bobbin 31 and the permanent magnet strip 28. The comb pieces 38 and 40 may be grounded via self adhesive copper tape 55 to the coil 37 and case 20.

The sensor assembly 10 also includes a cover 56 for enclosing the case 20. The cover 56 extends longitudinally and has an inverted general "U" shape cross-section. The cover 56 has a generally planar base wall 58 and side walls 60 extending generally perpendicular from the base wall 58 to form a longitudinal cavity 62. The case 20 is disposed within the longitudinal cavity 62. The cover 56 also includes a flange 64 extending longitudinally from the side walls 60. The flanges 64 have an aperture 66 extending therethrough and are to secured by suitable means such as fasteners (not shown) extending through the apertures 66 to secure the cover 56 to the body portion 16. It should be appreciated that the case 20 is sandwiched between the base wall 58 of the cover 56 and the surface of the body portion 16.

Figure 5:
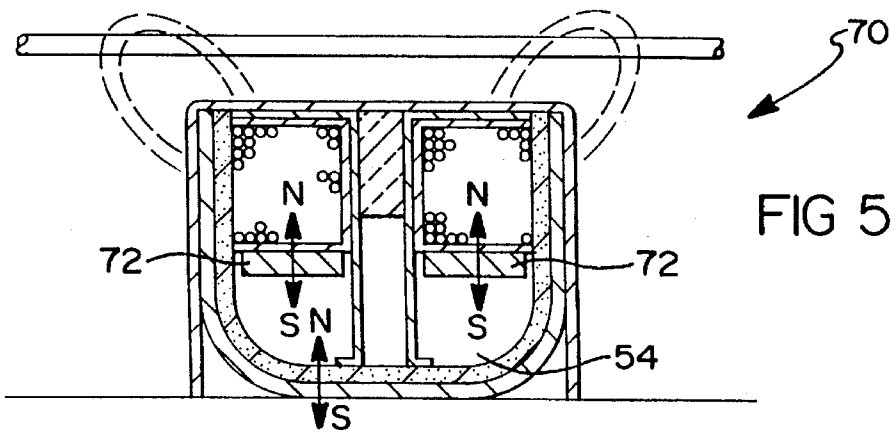
FIG. 5 is a view similar to FIG. 4 of an alternate embodiment, according to the present invention, of the sensor assembly of FIG. 1.

Referring to FIG. 5, an alternate embodiment of the sensor assembly 10 is shown. Like parts of the sensor assembly 10 have the same numerals for the sensor assembly 70. The sensor assembly 70 has at least one focusing magnet 72 disposed in the space 54 for concentrating the flux field up higher within the sensor assembly 10. The focusing magnets 72 are a permanent magnet strip secured to the bottom wall 33 of the bobbin 31 by suitable means such as an adhesive bonding agent. It should be appreciated that the focusing magnets 72 are optional.

Figure 6A:
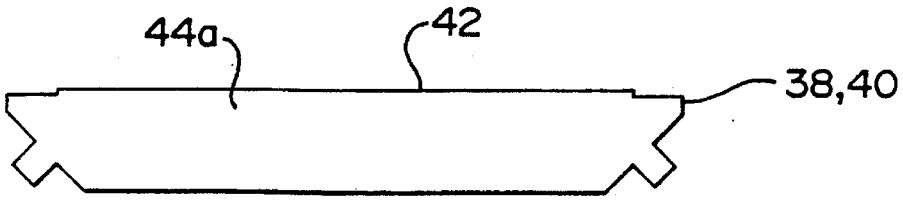
FIGS. 6A through 6F are plan views of several embodiments of a portion of the sensor assembly of FIG. 2.
Figure 6B:
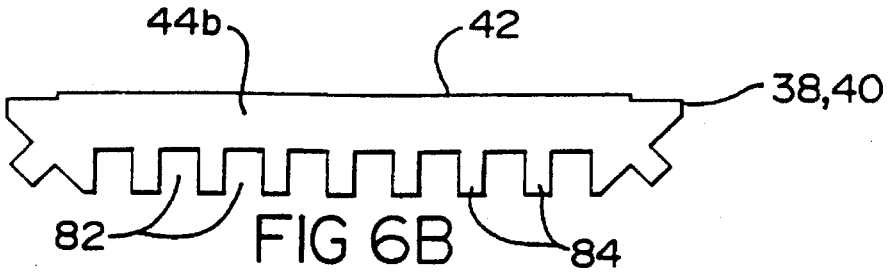
Figure 6C:
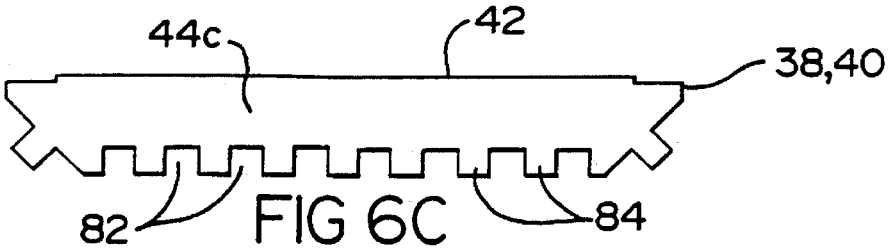
Figure 6D:
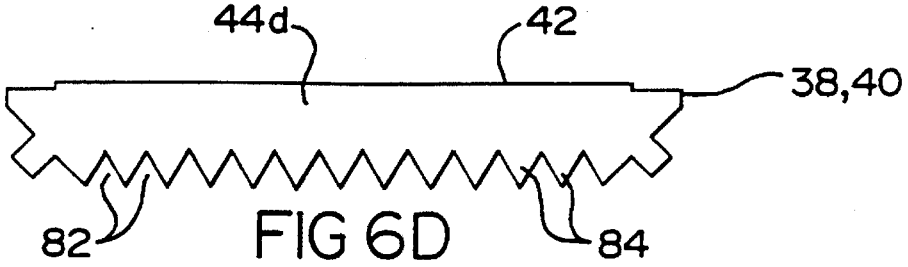
Figure 6E:
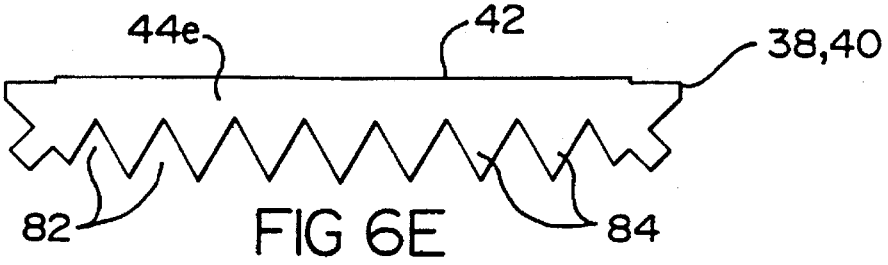
Figure 6F:
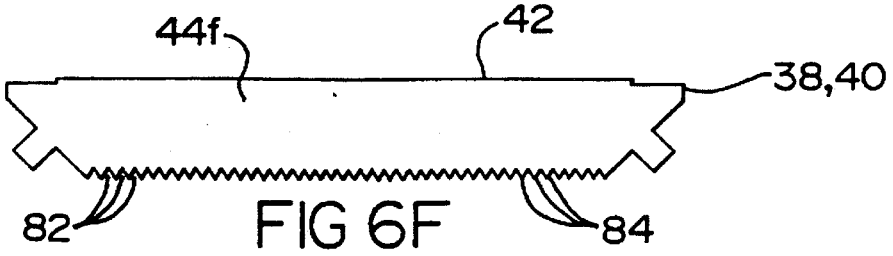

Referring to FIG. 6A, the comb pieces 38 and 40 are illustrated. The comb pieces 38 and 40 have a solid continuous arm portion 44*a*. As illustrated in FIG. 6B, the comb pieces 38 and 40 may have an arm portion 44*b* with a plurality of recesses 82 at exposed exterior edges thereof to define rows of tooth-like projections or teeth 84 for a function to be described. The recesses 82 are generally rectangular in shape and have a width greater than a width of the teeth 84. In FIG. 6C, the arm portion 44*c* has a plurality of recess 82 and teeth 84 in which the teeth 84 have a width approximately equal to a width of the recesses 82. As illustrated in FIG. 6D, the recesses 82 and teeth 84 of the arm portion 44*d* are generally "V" shaped and equal in width. In FIG. 6E, the recesses 82 of the arm portion 44*e* have a depth greater than a width thereof and in FIG. 6F, the recesses 82 of the arm portion 44*f* have a depth less than a width thereof.

In operation of the sensor assembly 10, the permanent magnet strip 28 is disposed in the channel 26 and mounted to the interior surface of the case 20 by suitable means such as an adhesive bonding agent. Next, the coil assembly 30 is disposed in the channel 26 adjacent the permanent magnet strip 28. The comb pieces 38 and 40 are disposed within the space 36 of the coil assembly 30 and the spacer 52 is disposed between the comb pieces 38 and 40 to press and lock the coil assembly 30 within the channel 26. The comb pieces 38 and 40 are magnetically polarized to the N polarity of the adjacent face of the permanent magnet strip 28. The magnetic flux radiates through the arm portions 44 as indicated by the flux lines FL, in a radial fan out, to the nearest oppositely polarized side wall 24 as illustrated in FIG. 4. If there are recesses 82 and teeth 84 in the arm portions 44 as illustrated in FIGS. 6B through 6F, they define magnetic flux bottles or geometric flux shaping forms in each recess 82. When a string 18 moves across the magnetic field, the flux pattern will change, thus inducing a voltage in the coil 37.

Accordingly, the sensor assembly 10 has preferably one permanent magnet strip 28 in continuous intimate contact with the interior surface of the case 20. Also, the comb pieces 38 and 40 are arranged in a lateral relationship, resulting in one magnet strip 28 assembled in one longitudinally extending case 20, making it less expensive to manufacture and assemble.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. A sensor assembly for a stringed musical instrument having a plurality of moveable strings comprising:

a case including means for forming a longitudinal channel;

at least one magnet disposed in said longitudinal channel along an interior surface of said channel forming means;

at least one coil disposed in said longitudinal channel; and means disposed in a space within said coil for pressing said coil against said magnet to lock said coil within said longitudinal channel.

2. A sensor assembly as set forth in claim 1 wherein said at least one magnet is a flexible permanent magnet strip.

3. A sensor assembly as set forth in claim 2 wherein said permanent magnet strip is rectangular in shape.

4. A sensor assembly as set forth in claim 1 wherein said case extends longitudinally and has a U-shape.

5. A sensor assembly as set forth in claim 1 wherein said case has an arcuate base wall and a pair of planar side walls parallel to each other to form said longitudinal channel.

6. A sensor assembly as set forth in claim 1 wherein said at least one coil comprises a bobbin extending longitudinally and spaced laterally and wire wrapped around said bobbin.

7. A sensor assembly as set forth in claim 1 wherein said locking means comprises a plurality of comb pieces disposed within said at least one coil and a spacer disposed between said comb pieces.

8. A sensor assembly as set forth in claim 7 wherein each of said comb pieces have a leg portion and an arm portion extending perpendicular to said leg portion.

9. A sensor assembly as set forth in claim 8 wherein said arm portion has a longitudinal length greater than a longitudinal length of said leg portion.

10. A sensor assembly as set forth in claim 8 wherein said leg portion has a height greater than a height of said coil and greater than a lateral width of said arm portion.

11. A sensor assembly as set forth in claim 8 wherein said arm portion has a plurality of longitudinally spaced teeth.

12. A sensor assembly as set forth in claim 8 wherein said spacer is rectangular in shape.

13. A sensor assembly as set forth in claim 12 wherein said spacer is made of a non-conductive, non-magnetic insulating material.

14. A sensor assembly for a stringed musical instrument having a plurality of moveable strings comprising:

a case having a longitudinal channel;

a magnet disposed in said longitudinal channel along an interior surface of said case;

a coil disposed in the interior of said longitudinal channel; and a pair of comb pieces and a spacer disposed in a space within said coil to press said comb pieces against said coil and said coil against said magnet to lock said coil within said longitudinal channel.

15. A sensor assembly as set forth in claim 14 wherein said magnet is a flexible permanent magnet strip.

16. A sensor assembly as set forth in claim 14 wherein said case extends longitudinally and has a U-shape.

17. A sensor assembly as set forth in claim 14 wherein said case has an arcuate base wall and a pair of planar side walls parallel to each other to form said longitudinal channel.

18. A sensor assembly as set forth in claim 14 wherein said coil comprises a bobbin extending longitudinally and having conductive wire wrapped around said bobbin.

19. A sensor assembly as set forth in claim 14 wherein said comb pieces have a leg portion and an arm portion perpendicular to said leg portion.

20. A sensor assembly for a stringed musical instrument having a plurality of moveable strings comprising:

a case having a base wall and a pair of side walls forming a U-shape and extending longitudinally to form a channel;

a permanent magnet extending longitudinally along an interior surface of said base wall and side walls;

a bobbin extending longitudinally and having a coil wrapped therearound and disposed in said channel;

a plurality of comb pieces extending longitudinally and disposed within a space in said bobbin; and a spacer disposed in the space within said bobbin and between said comb pieces to press said comb pieces against said bobbin and said bobbin against said magnet to lock said bobbin and comb pieces within said channel.

* * * * *